US006374558B1

(12) United States Patent
Surowiecki

(10) Patent No.: US 6,374,558 B1
(45) Date of Patent: Apr. 23, 2002

(54) WALL BEAM AND STUD

(76) Inventor: Matt Surowiecki, 22101 SE. 29th Pl., Issaquah, WA (US) 98029

( * ) Notice: Subject to any disclaimer, the term of this patent is extended or adjusted under 35 U.S.C. 154(b) by 0 days.

(21) Appl. No.: 09/293,074

(22) Filed: Apr. 16, 1999

(51) Int. Cl.[7] ..... E04H 1/00

(52) U.S. Cl. ..... 52/241; 52/690; 52/737.6; 52/481.1; 52/290

(58) Field of Search ..... 52/481.1, 737.6, 52/241, 290, 690, 732.1, 735.1, 729.1, 483.1

(56) References Cited

U.S. PATENT DOCUMENTS

| | | | | | |
|---|---|---|---|---|---|
| 3,680,271 | A | * | 8/1972 | Satchell | 52/656 |
| 3,733,755 | A | * | 5/1973 | Butler | 52/36 |
| 4,805,364 | A | * | 2/1989 | Smolik | 52/241 |
| 4,854,096 | A | * | 8/1989 | Smolik | 52/241 |
| 4,918,899 | A | * | 4/1990 | Karytinos | 52/690 |
| 5,127,203 | A | | 7/1992 | Paquette | |
| 5,127,760 | A | | 7/1992 | Brady | |
| 5,203,132 | A | * | 4/1993 | Smolik | 52/241 |
| 5,471,805 | A | | 12/1995 | Becker | |

OTHER PUBLICATIONS

Sweet's Catalog File, McGraw–Hall Information Systems Company.

Fire Resistance Design Manual, Gypsum Association.

* cited by examiner

*Primary Examiner*—Beth A. Stephan
*Assistant Examiner*—Pat J. Chavez

(57) ABSTRACT

A channel construction beam, typically metal, comprises a plurality of chutes of rectangular cross-section perpendicular to the beam for receiving a plurality of generally rectangular building studs in sliding relation within the chute. The chute comprises two or more vertical guides on each chute side inward of the beam channel aligned on a line normal to the beam web. Opposing beam ridges projecting inward of the channel may comprise the chute alignment guides. In an alternative embodiment, the chute may comprise projections outward of the beam channel sized to receive a building stud or a stud tongue extending from the stud and running longitudinally along opposing stud sides. Wall board is combined with the beam to provide a fire-rated wall. The wall stud comprises a longitudinal slot in which a screw attached to the beam flange may slide without restricting vertical movement of the stud in the beam.

17 Claims, 14 Drawing Sheets

WALL BEAM AND STUD

BACKGROUND

1. Field of the Invention

This invention relates to building wall construction and, more particularly, to channel header and footer beams and matching studs.

2. Prior Art

Interior wall construction using horizontal channel beams as headers and footers and matching vertical studs received into the channel beams is well-known. Commonly, the studs are also channel-shaped and both are made of metal, typically steel.

An advantage of steel wall construction is the strength of the wall and ease of assembly, the studs snapping into place in the beam within a retaining device in the beam. A screw between the beam and the stud then secures them together. U.S. Pat. Nos. 4,854,096 and 4,805,364 by Smolik represents such construction. Smolik shows his retaining device as a portion of the beam bent over at selected positions to hold a stud therebetween or the entire end of a beam flange bent over and slotted to receive a stud in the slot. The stud is then urged into place as the beam slightly spreads and the stud slightly closes, resiliently springing back into original form as the stud slips into place. Disassembly is also an advantage as the stud can be removed from the beam about as easy as it is slipped into place.

Another advantage of steel wall construction is that it provides a strong interior nonbearing wall that can be configured to allow building movement such as during a seismic event without damage to the wall. Paquette (U.S. Pat. No. 5,127,203) and Brady (U.S. Pat. No. 5,127,760) describe a beam with slots in each beam flange. A building stud is placed in the beam at a slot and a screw is inserted through the slot and into the stud. Thus, upon movement of the building, the studs can slide vertically in the beam as the screws slide in the beam slots. The allowed vertical movement of the beams is clearly limited to the length of the slot as the screw is constrained to slide within it. Resistance to lateral movement of the studs in the beam is by the shear strength in the screws and what further construction might be on the wall, such as wallboard. Each screw must be precisely installed by a tradesman who is in a hurry. The screw must not be too tight that it binds and prevents the sliding motion for which it was designed. It also must not deform the beam which would need to be repaired before use so that a channel wall can tolerate movement during a seismic event, or building expansion or contraction. It must also not be loose such that it prevents wall board installation over it. It is preferred that the wall be configured so studs can slide in the beam without screws that can require additional labor and careful attention on installation.

Vertical alignment of studs is typically done manually during construction with a stud connected between a footer beam and a header beam. Screws generally are employed to hold a metal stud in the metal footer and header beams. It is preferable to use simple channel beams as either the footer or the header beam and use beams with stud-retaining devices as the other beam only. It would be preferable also to avoid the labor cost of manually aligning each stud vertically or aligning a header beam with a footer beam when both employ beams that receive a building stud in a defined position in the beam. To do so, the beam should have an inherent alignment device incorporated so during construction a stud is aligned perpendicular to the beam as its first end is installed in the beam independent of another beam to which the other stud end may or may not be installed. In this way, a simple beam can be employed, for example, as a footer beam while the stud-aligning beam can be used as header beam. If that header beam also allowed the building stud to slide within the beam, it also could allow for building movement, expansion and contraction. If the stud sliding in the beam were not limited, except of course by the reach of the beam flanges, then the stud in beam wall construction could accommodate a larger range of movement than that allowed in the screws in slots approach.

SUMMARY OF THE INVENTION

It is therefore an object of the present invention to provide a channel beam that can be implemented as either a footer or a header beam that inherently aligns a building stud in a single beam perpendicular to the beam during assembly of the stud in the beam. Thus, a second aligning beam becomes unnecessary.

It is also an object that the stud be slidable in the beam without limits of movement imposed by slots or other restrictive means. It is another object that while the stud is free to move vertically in the beam, lateral movement of the stud in the beam is substantially impeded beyond that provided by screws, or entirely without screws, that must be precisely installed. It is a further object that the walls have a capability of a fire rating of at least one hour.

These primary objects are achieved in a channel beam comprising a plurality of chutes of rectangular cross-section, the chutes perpendicular to the beam for receiving a plurality of matching generally-rectangular building studs in unrestricted sliding relation within the chute. (Actually, metal studs are C-shaped with one side generally open. However, that generally open side also includes opposing lips in the plane of the side sandwiching the open area. These lips suffice for purposes of aligning the stud in the beam. Therefore, for purposes of descriptions following, the metal building stud with a generally-open side will be considered effectively closed with the lips providing necessary contacts for aligning the stud in the chute). The chute comprises two or more vertical alignment guides on each chute side aligned on a line normal to the beam web.

Opposing beam flanges perpendicular to the beam web on each side of the web may comprise chute alignment guides for two chute sides (a continuous side or line being equivalent in the limit to an infinite number of vertical guides). The other two opposing chute sides comprise at least two chute guides projecting from the beam flanges, usually connected at their distal ends for added strength and stability against lateral movement of the building stud. Each beam flange generally has a pair of these vertically-aligned guides providing redundant alignment to the studs.

A further definition of the chute may comprise rims extending from distal ends of beam flanges, slotted in alignment with flange slots with flange slots and rim slots bordering and defining chutes to receive studs therein. With two border points provided by the flange ridges, the flange rim provides a third defining border point to the chute and further enhances the flange rigidity and resistance to stud lateral movement.

In an alternative embodiment, the chute may comprise projections outward of the beam channel sized to receive a building stud or a tongue extending from the stud and running longitudinally along opposing stud sides.

In practice, a chuted beam of the present invention may be employed as a header in which case the stud is urged into the chute laterally as the beam and stud slightly stretch and bend until the stud snaps into place in the chute in vertical relation to the horizontal beam. To accommodate movement in the building, the stud is free to slide vertically in the beam chute but typically rests on a footer beam. This footer beam may be a simple channel beam without alignment or retaining devices because the stud is already vertically aligned by the header beam. The only limit to vertical stud movement is the extent of the chute which can be of arbitrary design length limited only by the size of the beam flanges which can be formed as large as desired.

With a horizontal wall board member on each side of a minor channel extension from the beam web adapted to receive anchors countersunk therein and a vertical wall board with an end sandwiched between each beam flange and a vertical beam panel parallel to the flange, the desired fire rating is achieved. In another embodiment, the desired fire rating is achieved by blowing noncombustible material into the beam between the beam web and stud ends positioned in the beam and spaced apart from the beam web. Gypsum wall board is then secured to the studs outside of the beam flange such that the flange is sandwiched between the studs and the wall board with board ends extending beyond the stud ends in the direction of the beam web. Thus, the wall board overlaps the noncombustible material in the beam to complete fire barrier. The studs with wall board attached are disposed to slide in the beam a distance measured between the wall board ends and the structure to which the beam web is anchored. As the studs slide in the beam, the stud comprising sides without a closed end cuts into the noncombustible material to create a slit imaging the stud with width that of each stud walls. Thus, the noncombustible material remains effectively undisturbed from possible stud movement during building shifting or a seismic event.

In another embodiment assuring a fire barrier, wall board is secured to the studs which together slide within the beam as an integral unit. Again, noncombustible material is blown into the beam between the beam web and stud ends positioned in the beam and spaced apart from the beam web. A first lip extends outward from the beam web past the flange. A matching second lip extends from the intermediate the flange, or even at the flange distal end creating a groove therebetween at a position overlapping the stud with wall board. Combustible material is inserted into the groove thus creating a wall barrier of desired thickness in the groove that overlaps the wallboard attached to the studs.

In still another embodiment, a first wall board member is attached outside the beam flange. A second wall board member is attached to the wall stud in vertical alignment with the first wall board member with ends of the first and second wall board members spaced apart to form a gap to allow the wall stud to slide within the beam channel without the wall board members impacting. A third wall board member overlaps the gap, attached either to the first wall board member creating a downward-opening groove in which the second wall board member slides, or to the second wall board member creating a upward-opening groove in which the first wall board member slides. The wall stud within the beam channel may included side slots through which screws attaching the first wall board member passes and in which the screw slides as the stud moves in the beam.

DETAILED DESCRIPTION OF THE INVENTION

Figure 1:
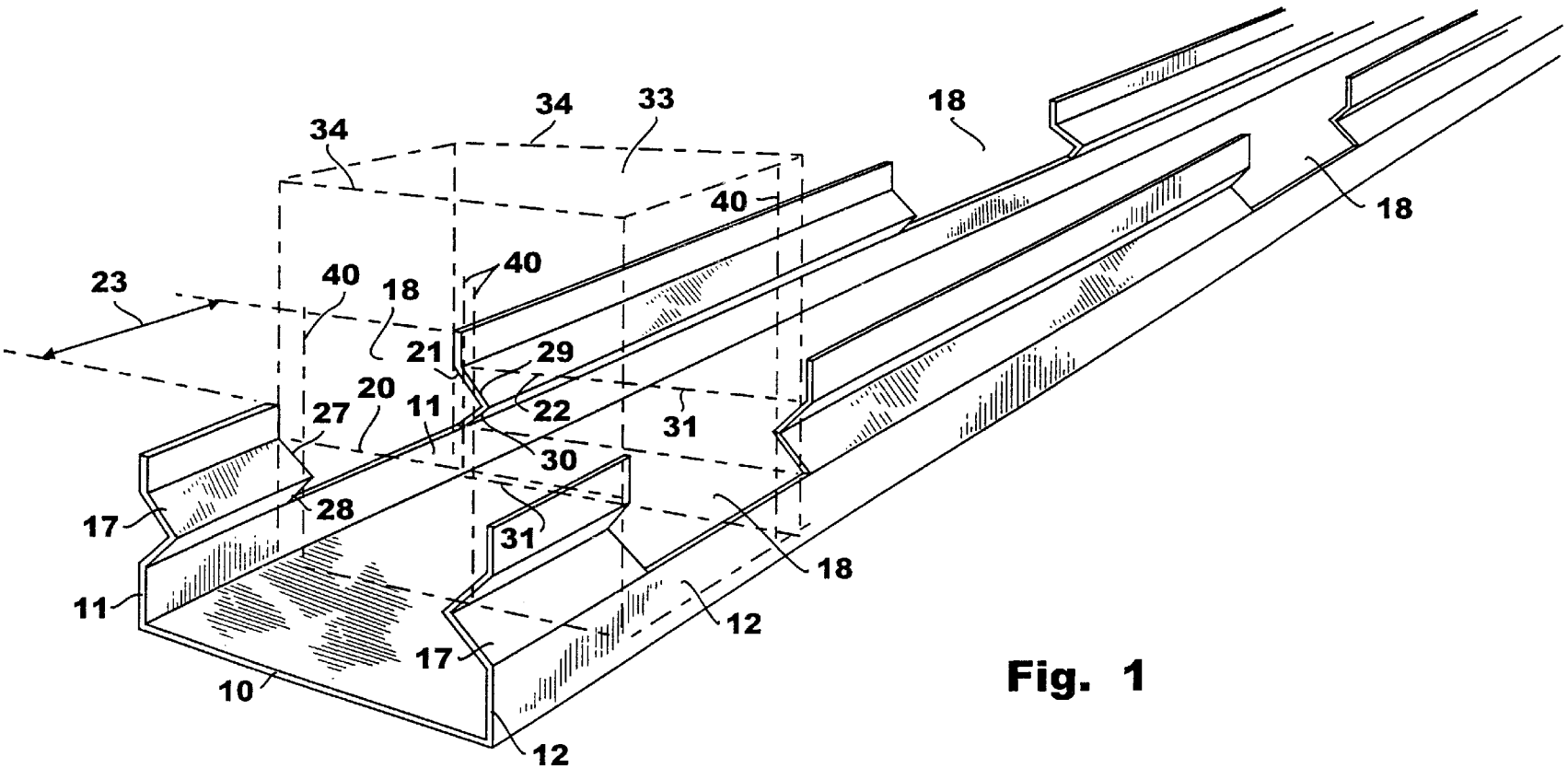
FIG. 1 is a perspective view of a channel beam shown as a footer with a ridge in each beam flange longitudinally projecting inward of the channel with a plurality of interruptions each forming a chute for receiving a building stud.
Figure 1A:
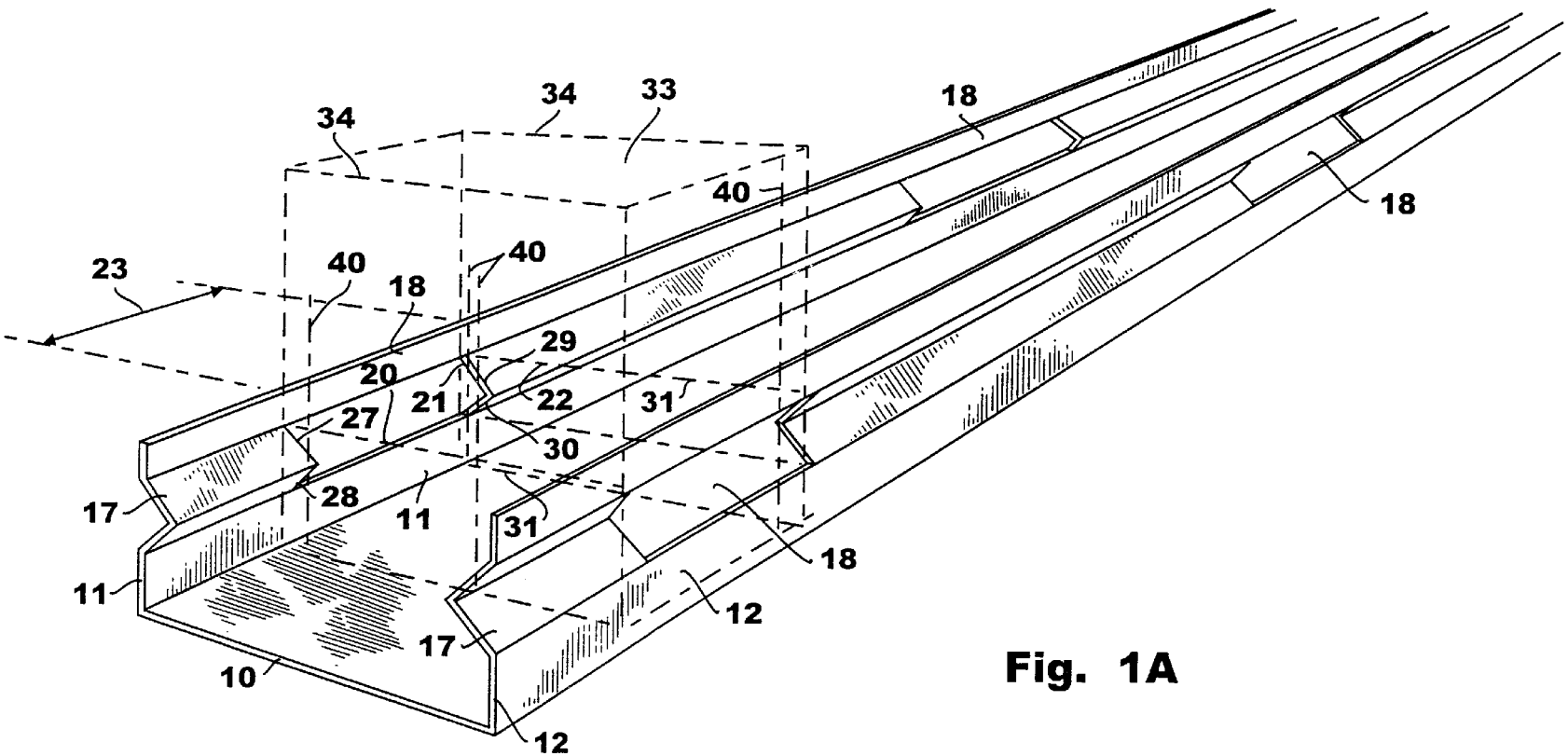
FIG. 1A is another perspective of the channel beam of FIG. 1 wherein the flange distal portion beyond the ridge continues unirterrupted.

The metal construction support beam of the present invention comprises a horizontal web 10 and first and second opposing flanges 11 and 12 formed of resiliently deflectable material depending vertically and approximately perpendicular from the web in parallel, spaced apart relation. The web and depending first and second opposing flanges form a generally U-shaped channel 13. The channel width 14 between the opposing flanges is approximately equal to a building stud cross-sectional length 15, and the channel depth 16 is defined by the extent of the opposing flanges from the web. At least one flange includes a ridge 17 intermediate its extent running longitudinally with the channel and projecting inward of the channel a distance required for selective stiffening of the flange for increased strength and rigidity. The beam may also comprise a minor channel 25 depressed into the web and running longitudinally therewith for receiving an anchor 26 for securing the beam to a building.

As shown in FIG. 1, the ridge 17 which runs substantially through the channel length includes at least one slot 18 interrupting the ridge along the channel at a leading ridge edge 19 at a leading slot boundary 20 and resuming the ridge at a following ridge edge 21 at a following slot boundary 22 spaced apart a slot width 23 approximately equal to a wall stud cross-sectional width 24 the ridge thus continuing from one slot to a successive slot.

Figure 2:
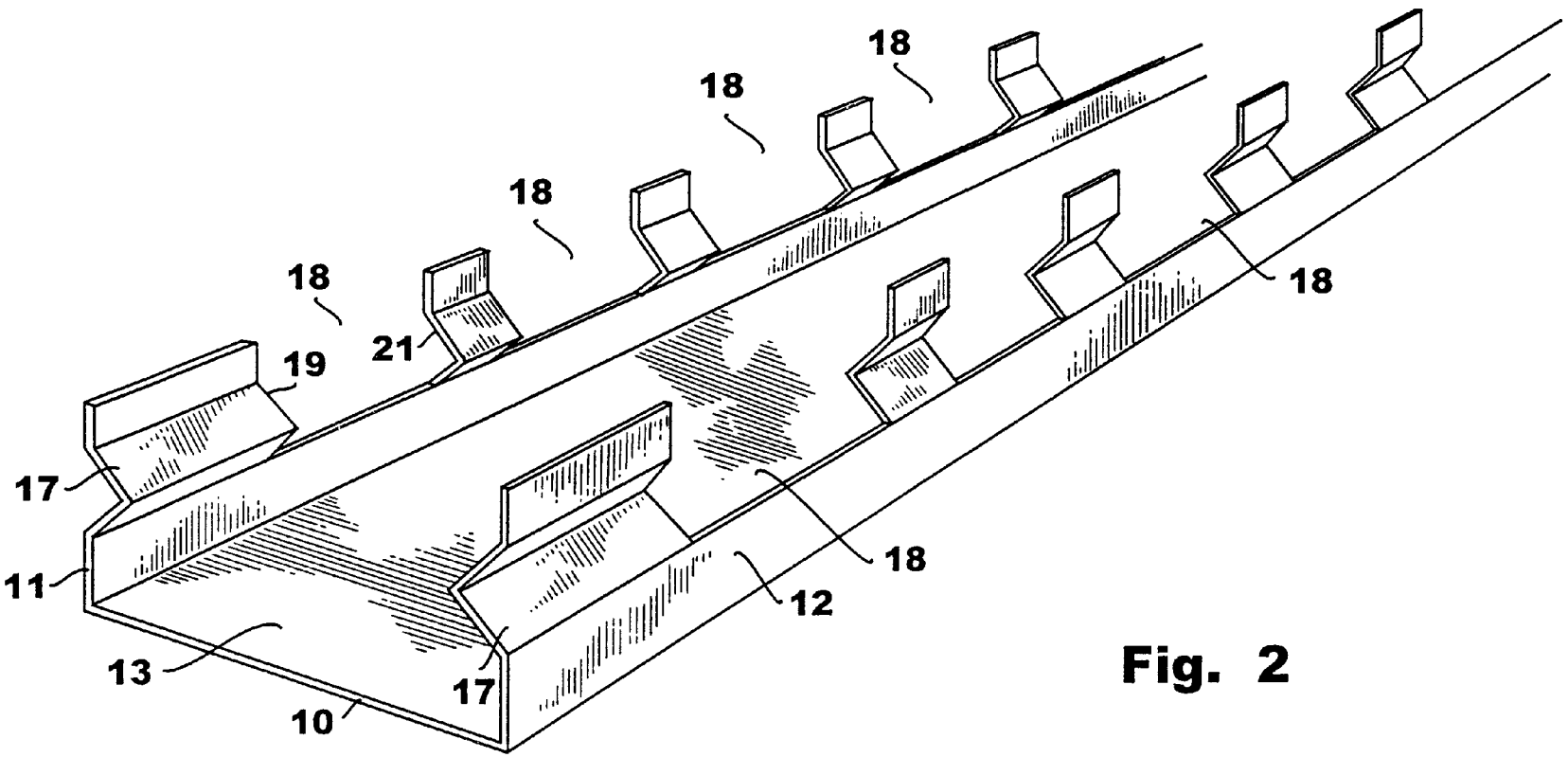
FIG. 2 is the beam of FIG. 1 further showing the chute-forming ridge interruptions closely spaced along the beam flanges.

At each ridge interruption, the leading ridge edge 19 defines a first, or upper, portion leading edge 27 and a second, or lower, portion leading edge 28. Similarly, the following ridge edge 21 also defines a first, or upper, portion following edge 29 and a second, lower, portion following edge 30. The upper and lower portions of both the leading and following ridge edges are aligned in parallel planes 31 approximately perpendicular to the web and also perpendicular to the beam flanges with the planes spaced apart a distance approximately equal to a cross-sectional width of a building stud 32 forming a chute 33 normal to the web for receiving a building stud 32 slidably within. The chute 33 is thus bounded within the channel 13 on first opposing sides 34 by the vertically-aligned leading edges and following edges. Beam flanges 11 and 12 at the ridge interruptions comprise the other two opposing chute sides 35 to slidably support a building stud 32 therein. The ridge at the chute boundaries thus also provides substantial restraints against lateral movement with unrestricted and unlimited sliding movement of the stud in the beams normal to the beam web. The beam typically comprises a plurality of chutes for defining positions along a building wall employing the beam. To enable options on placement and spacing of the building studs in the wall, the plurality of chutes may be closely spaced along the beam with a subset of the chutes selectively receiving studs in the construction, as shown in FIG. 2.

The beam ridge is typically formed by bending the beam flange intermediate the beam flange generally in a rectangular shape, a "V" shape, a "C" or other curvilinear projection (virtually any shape protrusion from the beam flange comprising two members separated or with portions separated) to form said first, or upper, portion 27 and said second, or lower, portion 28 projecting from a same beam flange joined at their distal ends within the channel. It may also be obtained by pressing the beam flange over a form. The vertically-aligned first and second portions are functionally significant in providing two points necessary to define a vertical line. A stud placed next to the aligned portions is then constrained to a vertical position perpendicular from the beam without interaction from another member such as a second beam.

Figure 3:
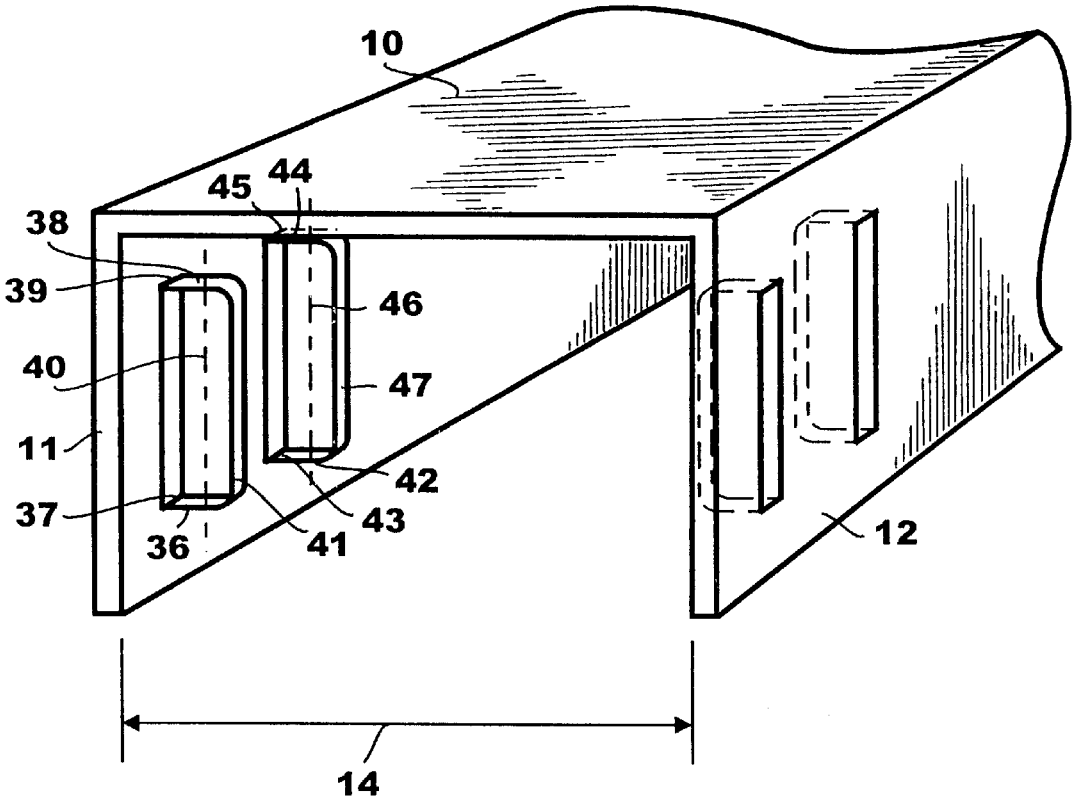
FIG. 3 is a perspective view of a beam shown as a header with a pair of chute-forming projections from the beam flange inward of the channel each projection forming a side of the chute, shown on a single beam flange, though matching pair of projections may electively project from the other beam flange.

As shown in FIG. 3, in an alternative embodiment the chutes may comprise a first protrusion 36 projecting inward of the channel from a first position 37 on a first beam flange 11 and a second protrusion 38 projecting inward of the channel from that beam flange projecting from a second position 39 on the same first beam flange spaced apart from the first position and aligned therewith on a first line 40 normal to the web which may be joined by a connecting member 41. A third protrusion 42 projects inward of the channel from a third position 43 on the same first beam flange 11 and a fourth protrusion 44 projects inward of the channel from that beam flange projecting from a fourth position 45 on the same first beam flange spaced apart from the third position and aligned therewith on a second line 46 normal to the web which may be joined by a connecting member 47. Similar groups of protrusions may project from the other in a similar manner to comprise redundant chute guides. That is, as above, the chute is defined by respective leading edges of said protrusion first and second portions aligned in a first plane approximately perpendicular to the web and to one side. Similarly, the respective leading edges of the ridge first and second portions are aligned in a second plane parallel to the first plane and spaced apart therefrom a distance approximately equal to a cross-sectional width of a building stud forming a chute normal to the web bounded on first opposing sides by the vertically-aligned leading edges and following edges and by second opposing sides comprising beam flanges for slidably supporting a building stud therein.

Figure 4:
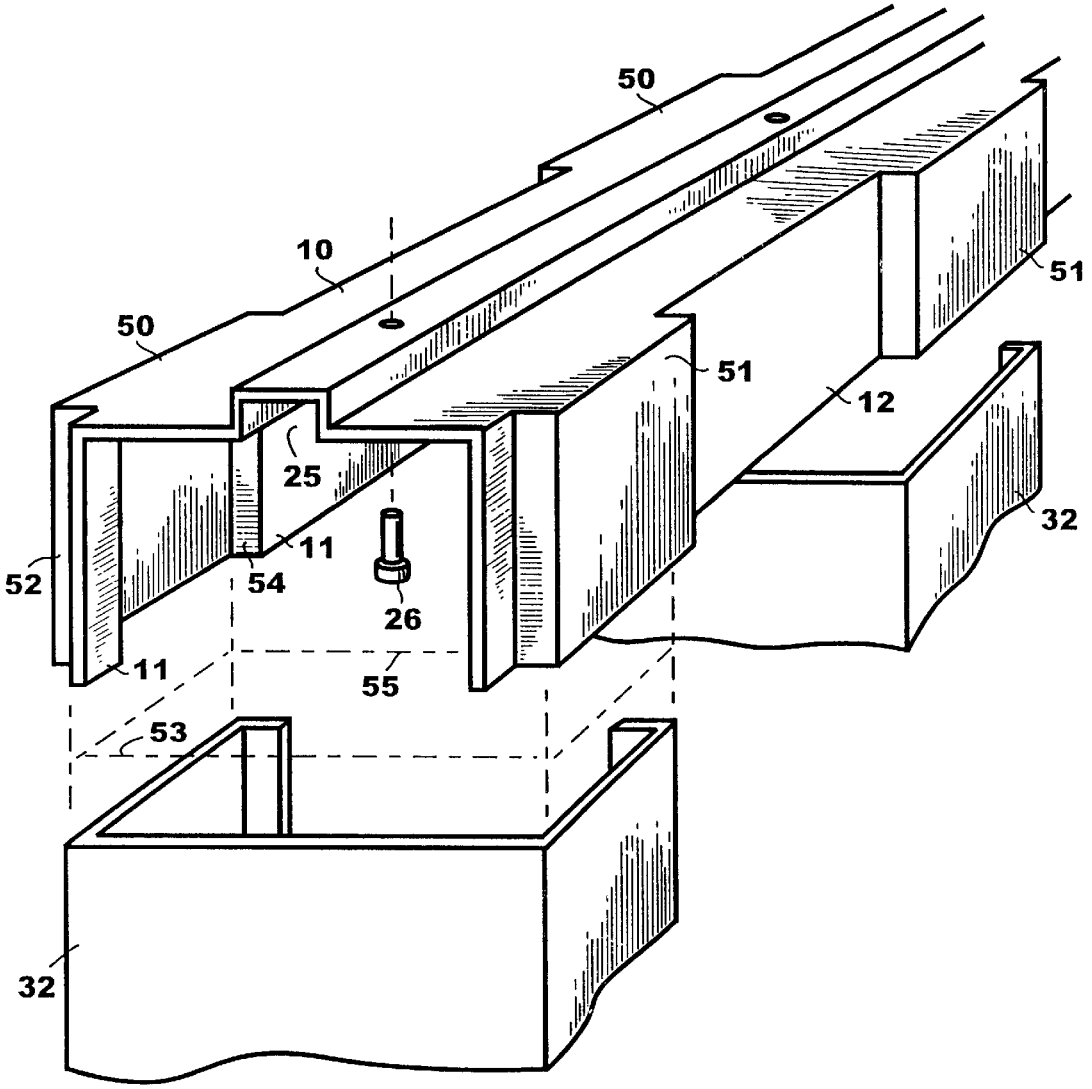
FIG. 4 is a perspective view of a beam shown as a header with a plurality of pairs of opposing projections outward from beam flanges, each pair of outward projections sized as a chute to receive a building stud. The studs also are shown ready to fit into the chute, each comprising three sides with opposing lips extending from ends of opposing stud sides to form an effective fourth side such that an effective four-sided stud is held in the beam chute slidably in perpendicular relation to the beam. The beam web also includes a minor channel for receiving anchors countersunk within.
Figure 5:
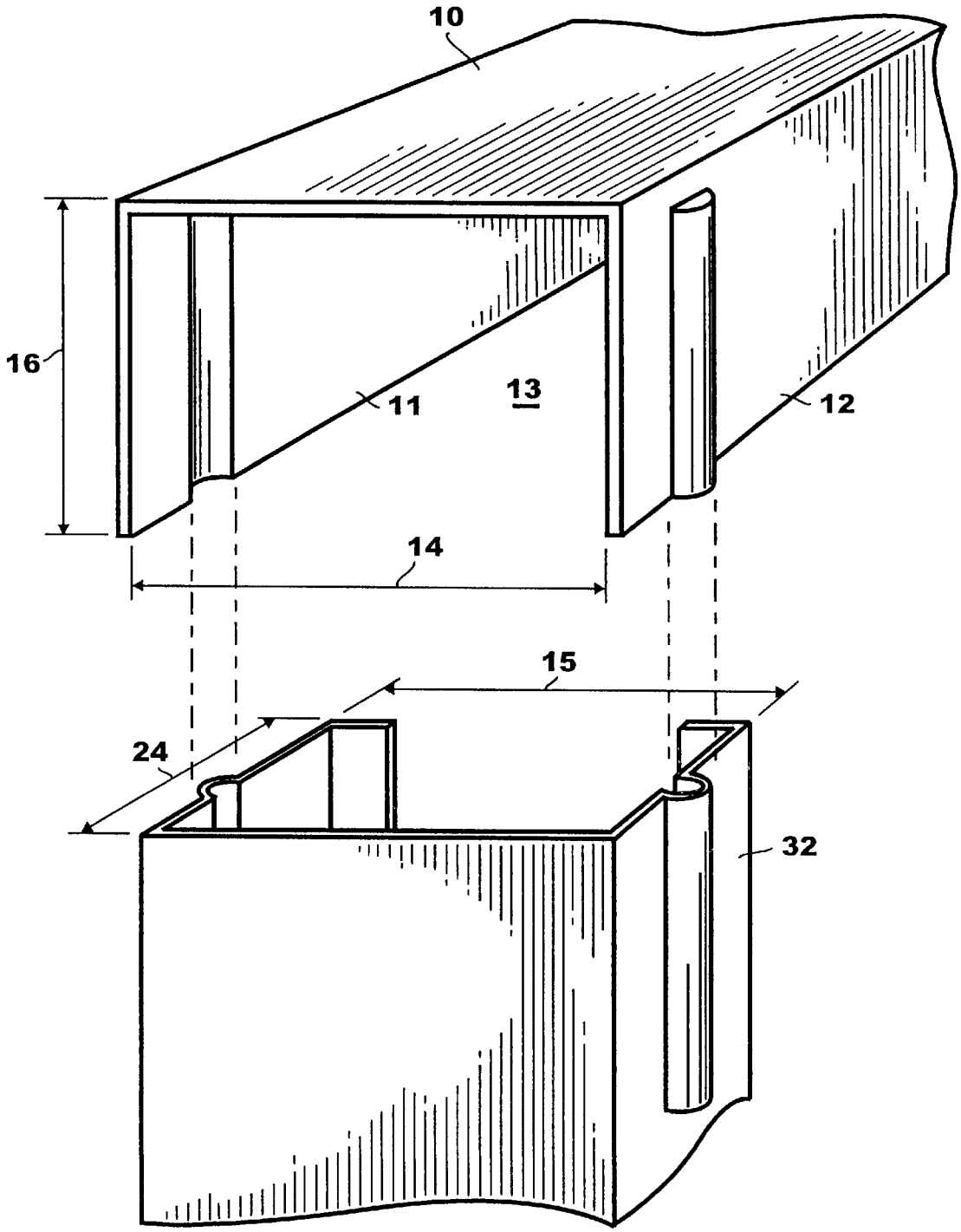
FIG. 5 is a perspective view of a beam shown as a header with a pair of opposing grooves extending outward of the channel on the beam flanges, respectively, for receiving a stud with a tongue on opposing sides matching the beam flange opposing grooves. The stud, also shown, shows the tongue running from the stud end a distance to match the grooves then truncating.

In a further alternative embodiment shown in FIG. 4, the chute may comprise opposing protrusions 50 and 51 outward of the beam on each beam flange. Thus, each protrusion comprises a beam flange portion displaced outward of the channel a distance between the opposing protrusions approximately equal to the building stud cross-sectional length for receiving a building stud therein. A leading chute side 52 at a leading chute boundary 53 and a following chute side 54 at a following chute boundary 55 define the chute having a chute width approximately equal to a wall stud cross-sectional width. Each chute side comprises at least two guide members (not shown) aligned longitudinally with the chute on a line normal to the beam web to maintain the stud normal to the web, or equivalently, continuous vertical chute sides 52 and 54 normal to the web.

Figure 6:
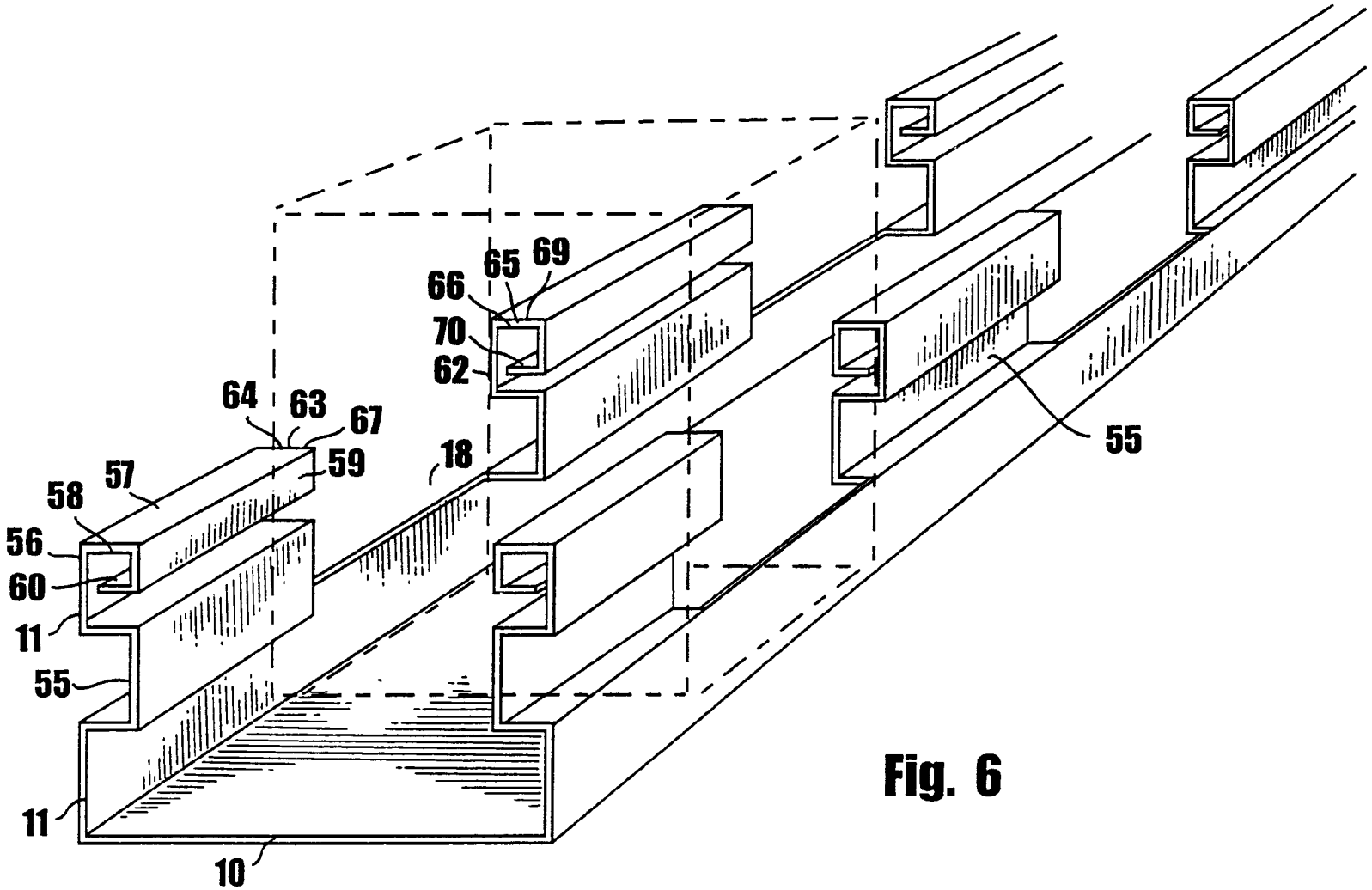
FIG. 6 is a perspective view of a beam shown as a footer and including opposing flanges terminating at their distal ends in flange rims and having rectangular ridges protruding inward of the beam channel intermediate the flanges. The rims as shown include a first horizontal member extending from the flange from which a vertical member depends with a second horizontal member attached directed back toward the flange. A plurality of opposing slots interrupt the flanges to form a plurality of chutes bordered by the ridge and rim.
Figure 7:
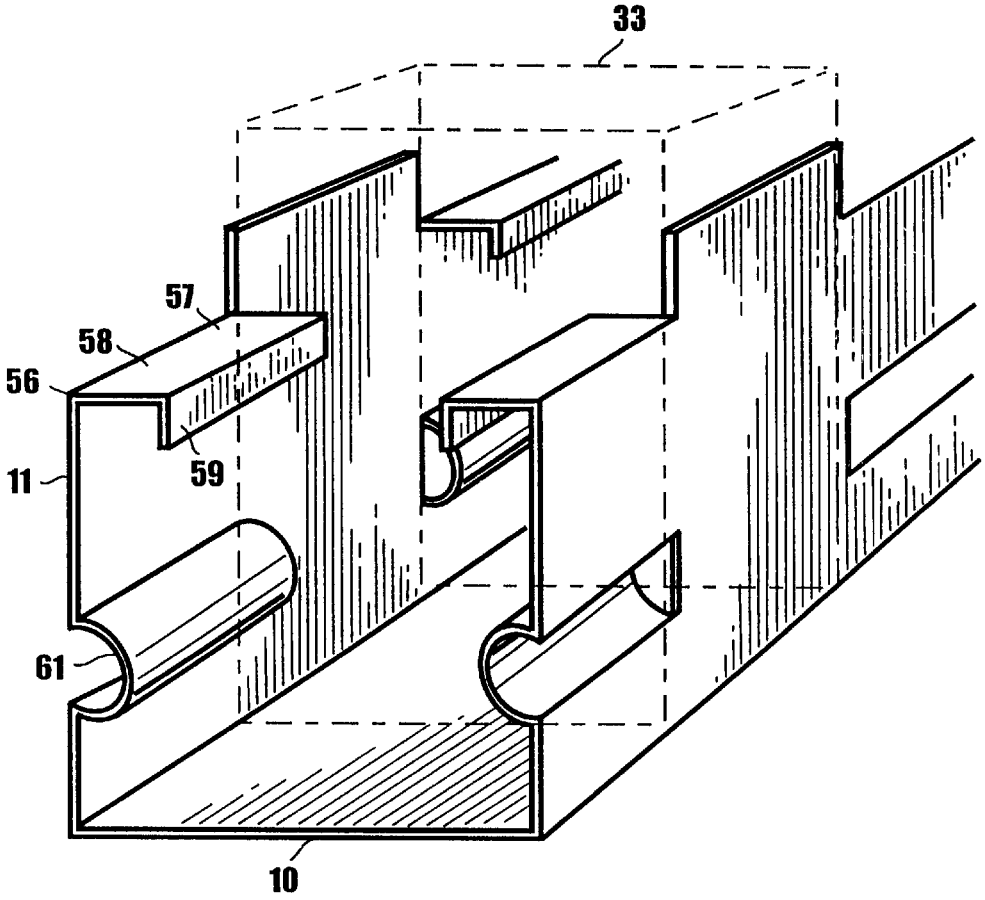
FIG. 7 is a perspective view of a beam also shown as a footer and including opposing flanges terminating at their distal ends in flange rims and having curvilinear ridges protruding inward of the beam channel intermediate the flanges. The rims as shown include a first horizontal member extending from the flange from which a vertical member depends. A plurality of opposing slots interrupt the flanges to form a plurality of chutes bordered by the ridge and rim. The rims are shown bent inward from the flanges leaving the flange at the slots unbent.
Figure 8:
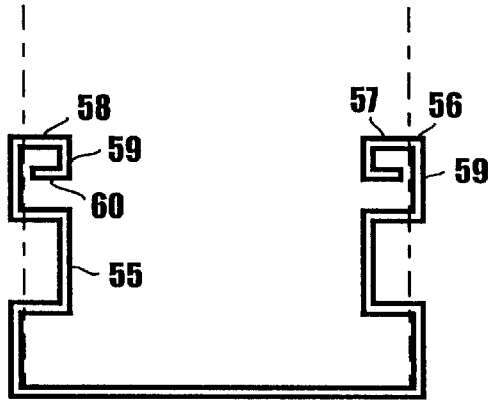
FIG. 8 is an end view of the beam shown in FIG. 6.
Figure 9:
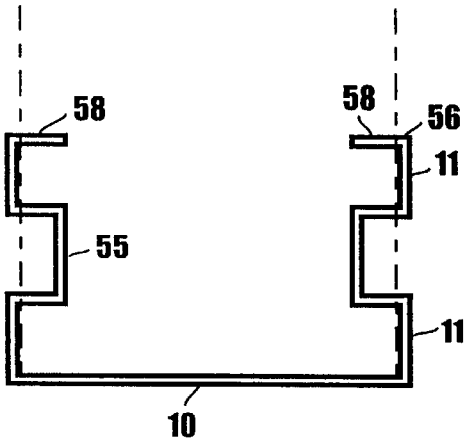
FIG. 9 is an end view of a beam similar to that shown in FIG. 6 except that the rim ends with the first horizontal member extending inward from the flange.
Figure 10:
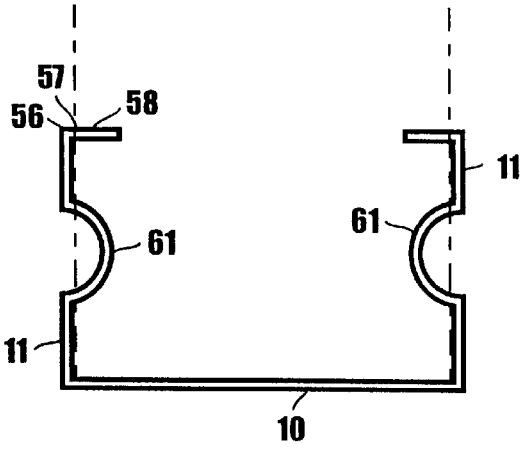
FIG. 10 is an end view of a beam similar to that shown in FIG. 9 except that the ridge is curvilinear instead of rectangular.

FIG. 6 shows the flange with a rectangular ridge 55 protruding from the flange. On the flange distal end 56 is a flange rim 57 which may include any projection extending inward from the flange at its distal end. In FIG. 9, the rim comprises a first horizontal member 58. FIG. 7 shows a vertical member 59 depending from the first horizontal member. FIG. 6 and FIG. 8 show a second horizontal member 60 extending from the vertical member back toward the flange. FIG. 10 shows the beam of FIG. 9 with a curvilinear ridge 61 substituted for the rectangular ridge. Additional rim members provide more flange strength and rigidity and resistance to lateral stud movement in the beam.

Figure 13:
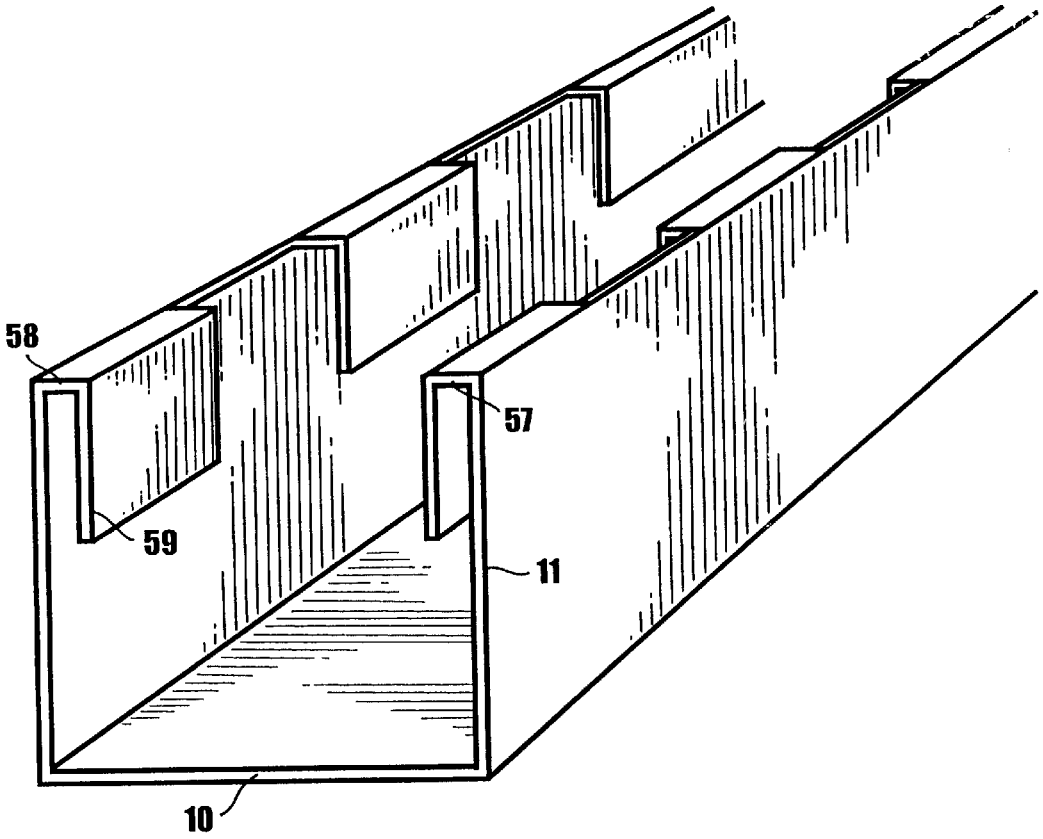
FIG. 13 is a perspective view of the beam showing a flange rim without a ridge intermediate the flange and including a horizontal member and a vertical member depending therefrom.
Figure 14:
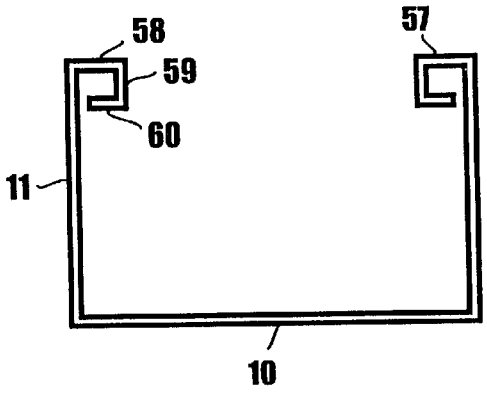
FIG. 14 shows the beam of FIG. 13 and further comprising a second horizontal member directed back toward the flange.

FIG. 13 shows the rim without a ridge intermediate the beam flange independently defining the chute with said first horizontal member 58 and said vertical member 59 depending from the horizontal member to provide the vertical definition of the chute. FIG. 14 shows the rim of FIG. 13 and further comprising said second horizontal member 60 directed from the vertical member back toward the flange, the two horizontal members thus providing two vertically-aligned borders of the chute necessary for chute definition.

As with the ridge, the rim includes at least one slot 62 aligned with the ridge slot 18 interrupting the rim along the channel at a leading rim edge 63 at a leading rim slot boundary 64 and resuming the rim at a following rim edge 65 at a following rim slot boundary 66 spaced apart a rim slot width equal to the ridge slot width and a wall stud cross-sectional width 24. Continuing the similarity, at each rim interruption, the interrupted first horizontal member defines a first, or upper, portion leading edge 67 and the second horizontal member defines a second, or lower, portion leading edge (not shown). Likewise, the interrupted first horizontal member defines a first, or upper, portion following edge 69 and the interrupted second horizontal member defines second, lower, portion following edge 70. Still similar to the ridges, the leading and following rim edges of both the first and second horizontal members are aligned in parallel planes approximately perpendicular to the web and also perpendicular to the beam flanges with the planes spaced apart the same ridge slot distance approximately equal to a cross-sectional width of a building stud 32 forming a chute 33 normal to the web for receiving a building stud 32 slidably within. When employed in concert with the flange slots, the rim slots provide further chute definition and strength.

Figure 11:
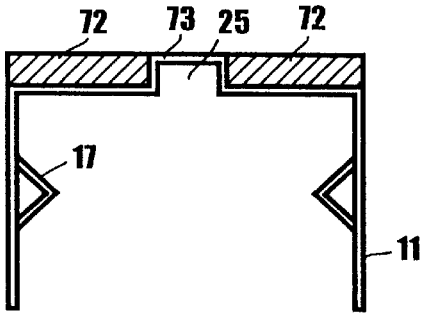
FIG. 11 is an end view of a beam shown as a header and including opposing ridges protruding from opposing flanges. A minor channel extends outward intermediate the web to receive countersunk anchors within forming ledges outside the minor channel above the web. On the ledges are horizontal dry wall members shown in cross-section.

As shown in FIG. 11, the beam comprising a minor channel 25 depressed in the web for countersinking an anchor and a ridge running longitudinally with the beam can be employed in combination with a wall board member 72 on each side of the minor channel projection 73 from the beam web, thus creating a beam with at least a 1-hour fire rating. Providing the beam with the integrated wall board also eliminates costly labor and time at the point of installation.

Figure 12:
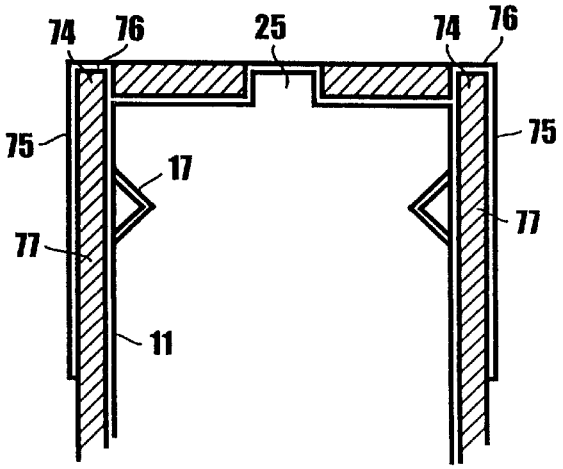
FIG. 12 is an end view of the beam of FIG. 11 and further comprising a flange outside panel on each web side parallel to and spaced apart from the flange depending from a web extension. Between each flange and outside panel is shown a vertical dry wall member.
Figure 15:
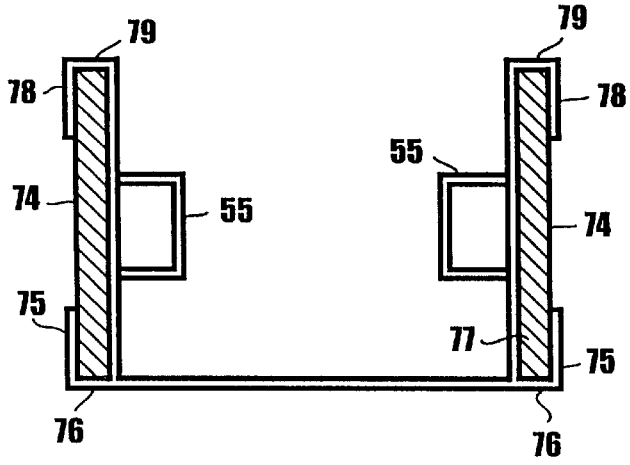
FIG. 15 is an end view of the beam showing a rectangular ridge with a flange panel similar to that of the beam of FIG. 12 and further comprising an additional flange outside panel on each web side parallel to and spaced apart from the flange at a flange distal end and securing a wall board member, shown in cross section, between the two panels and the flange.
Figure 16:
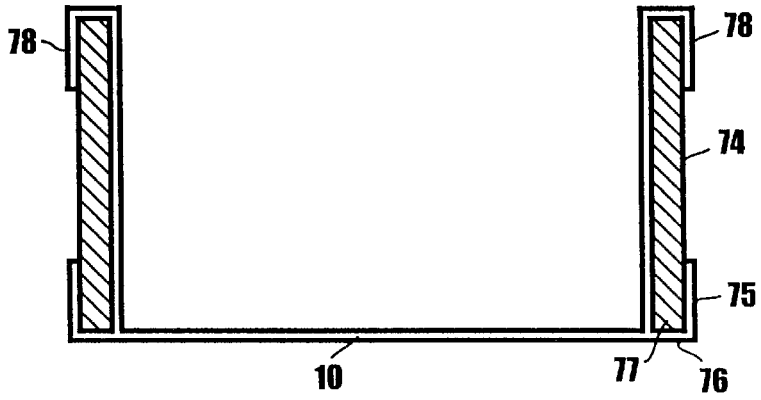
FIG. 16 is an end view of the beam of FIG. 15 without a ridge intermediate the flange.
Figure 17:
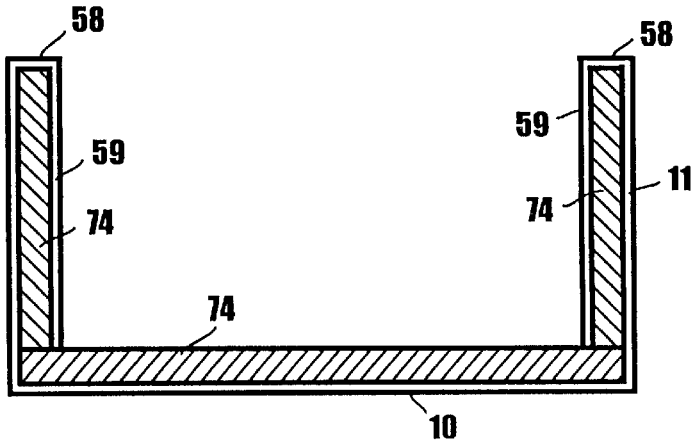
FIG. 17 is an end view of the beam of FIG. 13 further showing wall board members, shown in cross section, inside the beam channel on the inside of the web and flanges and the rim vertical members extending to the wall board member on the web.

As shown in FIG.12, the beam of FIG. 11 can further comprise a wall board member 74 outside of each flange. To retain the wall board member 74 to the beam, a first beam panel 75 depends from an extended web member 76 parallel to each flange creating a pocket 77 for receiving the wall board member. The panel extends no farther than the flange to receive a wall board end therebetween, the remaining wall board intended to continue down with an installed stud to form a wall. FIG. 15 shows a second beam panel 78 directed toward the first beam panel 75 and extending from a flange extension 79 extending horizontally outward from the flange distal end to form a C-shaped cavity. A wall board member 74 displayed in cross-section is shown secured within the cavity.

In an alternate embodiment, a noncombustible material 80 is inserted in the beam channel 13. A wall board member 74 is secured to studs 32 which together sandwich a wall flange therebetween with the wall board mounted on the studs extending beyond the studs to overlap the noncombustible material in the beam channel to complete a fire barrier. The studs remain slidable in the channel, cutting a slit in the noncombustible material in the image of the stud cross section as necessary during any movement but otherwise leaving the fire barrier undisturbed. The wall board members are secured to the studs at a position with ends spaced apart from the web or a structure to which the web is anchored to allow movement of the wall board and studs in the direction of the web and the structure without damaging the wallboard.

Figure 19:
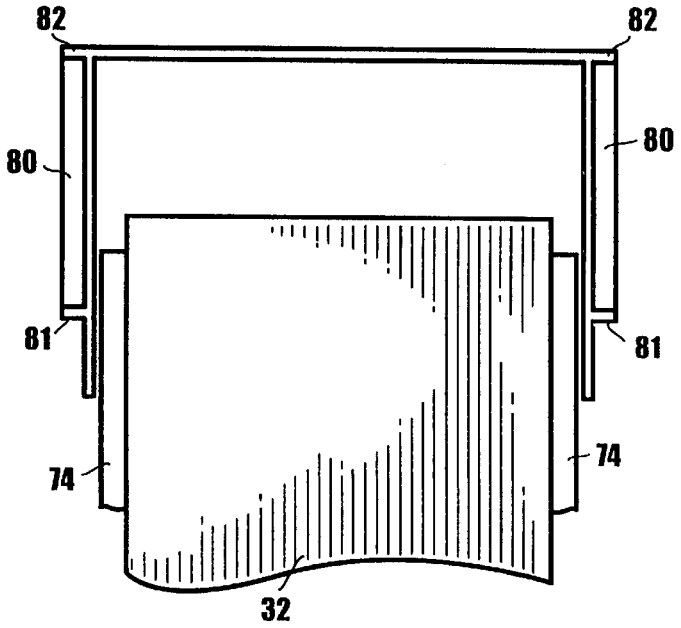
FIG. 19 is also an end view of a beam shown with wall board secured to the studs with both fitting together slidably in the beam channel. A noncombustible material is shown on the outside of the flanges overlapping the wallboard within the beam. The noncombustible material may comprise wall board secured to the outside of the flange or another noncombustible material which may be filled outside the flange and between two lips spaced apart on the flange.

In another embodiment shown in FIG. 19, the wallboard 74 is secured to the stud 32 and together fit slidable within the beam channel 13, again with noncombustible material inserted between the stud ends and the beam web. To the outside of the beam flange is secured a wall board 74 or other noncombustible material 80 overlapping the wallboard secured to the studs within. The noncombustible material 80 may be secured between a flange extension 81 extending from the flange outward of the beam channel and a web extension 82 spaced apart from the first lip and extending outward from the flange at the web.

Figure 20:
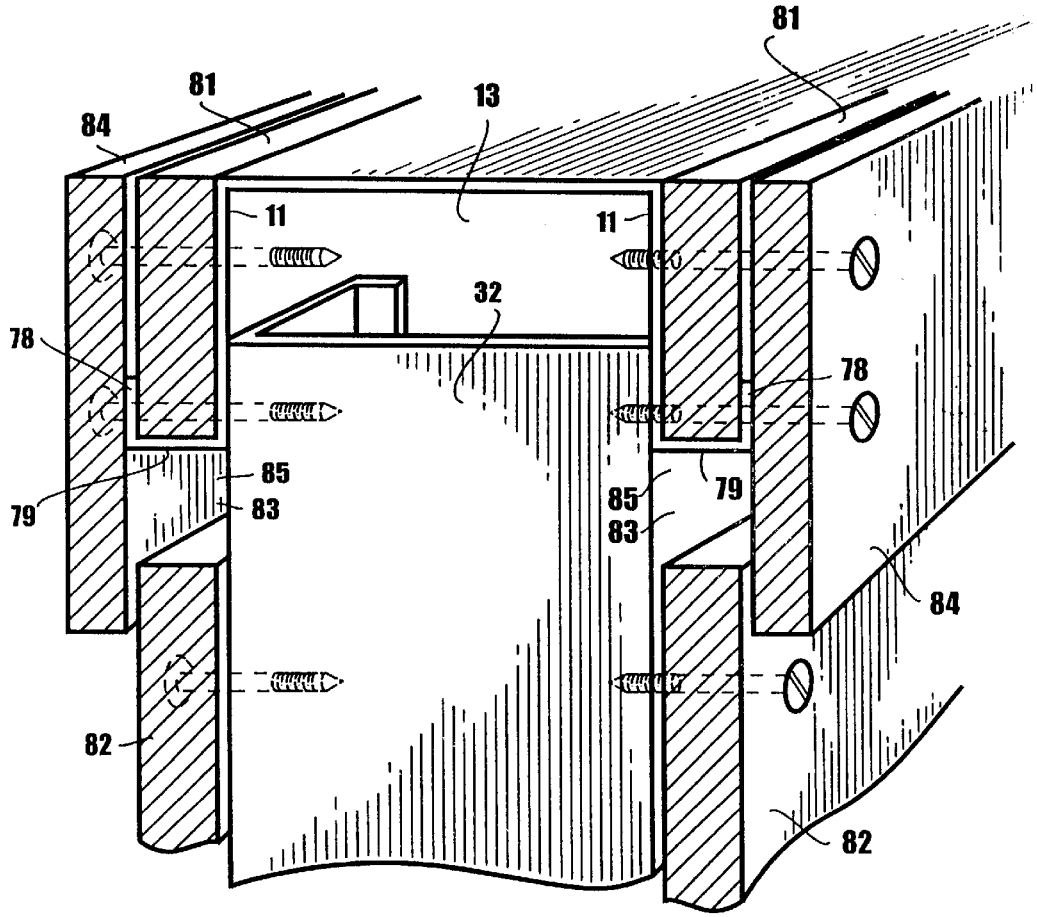
FIG. 20 is a perspective view of a wall stud slidable within a beam with a wall board members vertically aligned in spaced apart relation respectively attached to the beam flange and the stud and with another wall board member attached to the wall board member attached to the flange outside and overlapping the other wall board member.
Figure 21:
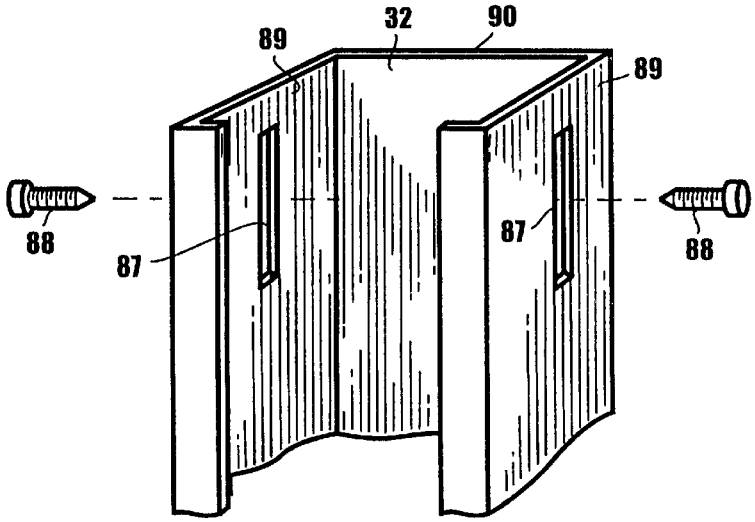
FIG. 21 is a perspective view of the 3-sided wall stud with an abbreviated fourth side showing side slots in which wall-board attaching screws slide.
Figure 22:
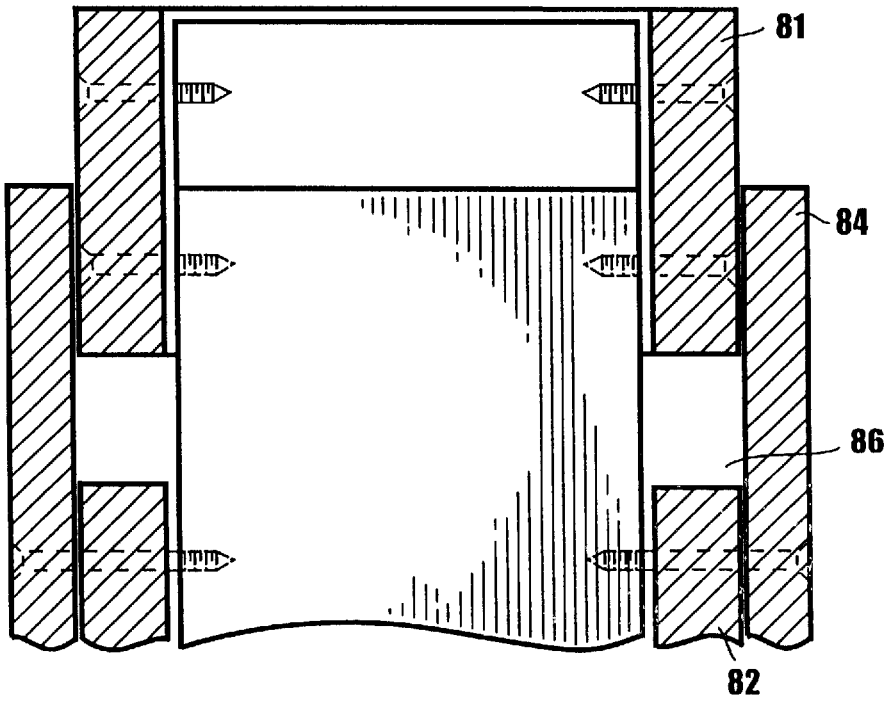
FIG. 22 is a perspective view of a wall stud slidable within a beam with a wall board members vertically aligned in spaced apart relation respectively attached to the beam flange and the stud and with another wall board member attached to the wall board member attached to the wall stud outside and overlapping the other wall board member.

FIG. 20 shows another embodiment of a first wall board member 81 attached outside the beam flange. A second wall board member 82 is attached to the wall stud 32 in vertical alignment with the first wall board member 81 with ends of the first and second wall board members spaced apart to form a gap 83 to allow the wall stud to slide within the beam channel 13 without the wall board members impacting. A third wall board member 84 overlaps the gap, attached to the first wall board member 81 creating a downward-opening groove 85 in which the second wall board member slides. To better support the first wall board member, a flange extension 79 extends from the flange 11 on which the first wall board member rests. A beam panel 78 parallel to the flange depends from the flange extension to form a groove in which the wall board panel is held. Alternatively, the third wall board member 84 is attached to the second wall board 82 member creating a upward-opening groove 86 in which the first wall board member slides. For ease of description, "downward-opening" is meant to be in the direction the beam channel opens, and "upward-opening" is meant to be in the opposite direction. The elongate wall stud comprises two opposing sides 89 separated by a back 90. The 3-sided wall stud 32 with an abbreviated fourth side that slides within the beam channel is shown in FIG. 21 with side slots 87 through which screws 88 attaching the first wall board member pass and in which the screws slide as the stud moves in the beam.

Figure 18:
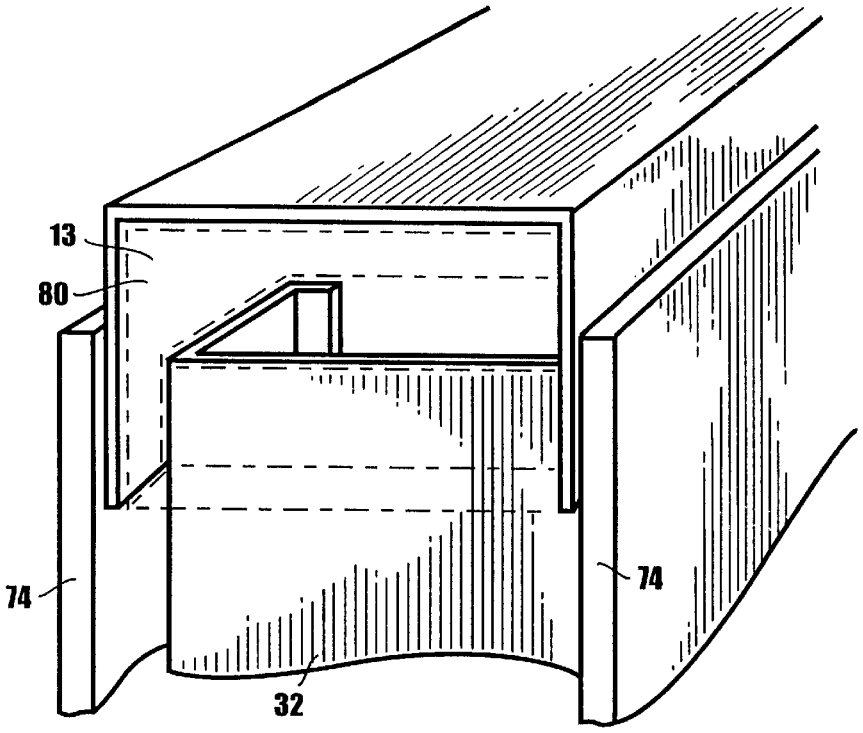
FIG. 18 is an end view of the beam with a ledge intermediate the flanges showing wallboard secured to a stud which together are sandwiched around the flanges. A noncombustible material is shown in the beam channel between the stud and the beam web with the wall board mounted on the studs beyond the stud ends to overlap the noncombustible material in the beam channel.
Figure 23:
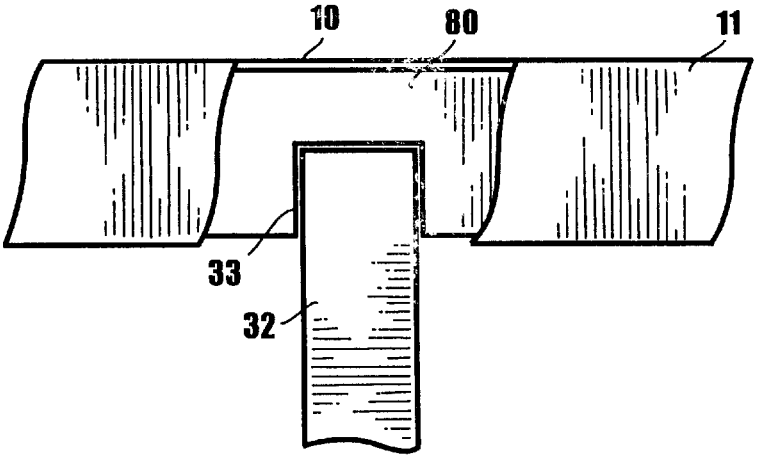
FIG. 23 is a plan side view of a wall stud in a beam with noncombustible material in the beam channel around the beam forming a restraining chute in which the stud can slide.

FIG. 23 is another embodiment, similar to that described in FIG. 18, in which the stud 32 in the beam channel 13 is surrounded by a noncombustible material 80 forming a chute 33 around the stud which restrains its lateral movement. Because the stud is essentially tubular, it is able to cut a vertical path in the noncombustible material above the stud which allows the stud to move vertically in the chute to accommodate building movement. Generally, the noncombustible material is blown into the beam channel after the stud is installed. When the noncombustible material hardens, it forms the desired chute about the stud. Because the hardened material has less material strength than the stud, the stud is able to cut its path in the material above it as the building moves without destroying its quality as a fire barrier.

What is claimed is:

1. A support beam comprising a horizontal web, first and second opposing flanges depending vertically and approximately perpendicular from the web in parallel, spaced apart relation, the web and depending first and second opposing flanges forming a generally U-shaped channel with first and second channel ends and having a channel width defined between the opposing flanges approximately equal to a building stud cross-sectional length and a channel depth defined by an extent of the opposing flanges from the web to flange distal ends, at least one flange further including a ridge intermediate its extent, spaced apart from flange distal ends, running longitudinally with the channel substantially from said first channel end to said second channel end and projecting inward of the channel a ridge projection distance, the ridge having at least one slot interrupting the ridge along the channel at a leading ridge edge at a leading slot boundary and resuming the ridge at a following ridge edge at a following slot boundary, said slot between ridge leading and following edges defining a slot width approximately equal to a wall stud cross-sectional width, the ridge continuing from a first slot to a successive slot.

2. A support beam comprising a horizontal web, first and second opposing flanges depending vertically and approximately perpendicular from the web in parallel, spaced apart relation, the web and depending first and second opposing flanges forming a generally U-shaped channel with first and second channel ends and having a channel width defined between the opposing flanges approximately equal to a building stud cross-sectional length and a channel depth defined by an extent of the opposing flanges from the web to flange distal ends, at least one flange further including a ridge running longitudinally with the channel substantially from said first channel end to said second channel end and projecting inward of the channel a ridge projection distance, the ridge having at least one slot interrupting the ridge along the channel at a leading ridge edge at a leading slot boundary and resuming the ridge at a following ridge edge at a following slot boundary, said slot between ridge leading and following edges defining a slot width approximately equal to a wall stud cross-sectional width, the ridge continuing from a first slot to a successive slot wherein the ridge further comprises first and second portions projecting from a same beam flange and joining at said ridge projection distance, said leading ridge edge comprising a leading edge first portion and a leading edge second portion and said following ridge edge similarly comprising a following edge first portion and a following edge second portion, leading edge portions and following edge portions disposed along the chute and generally perpendicular to the web, these portions engaging a stud that may be received into the chute in maintaining the stud in the chute orthogonal to the web.

3. The beam of claim 2 wherein said leading edge first and second portions are aligned in a first plane approximately perpendicular to the web and to the at least one flange and said following edge first and second portions are aligned in a second plane parallel to the first plane and spaced apart therefrom a distance approximately equal to a cross-sectional width of a building stud forming a chute perpendicular to the web bounded on first opposing sides by the vertically-aligned leading edges and following edges and by second opposing sides comprising said beam flanges for slidably supporting a building stud therein.

4. The beam of claim 2 wherein the ridge projects from the beam flange generally in a "V" shape, a first "V" first leg comprising said first portion and a second "V" leg comprising said second portion.

5. A support beam comprising a horizontal web, first and second opposing flanges depending vertically and approximately perpendicular from the web in parallel, spaced apart relation, the web and depending first and second opposing flanges forming a generally U-shaped channel with first and second channel ends and having a channel width defined between the opposing flanges approximately equal to a building stud cross-sectional length and a channel depth defined by an extent of the opposing flanges from the web to flange distal ends, at least one flange further including a ridge running longitudinally with the channel substantially from said first channel end to said second channel end and projecting inward of the channel a ridge projection distance, the ridge having at least one slot interrupting the ridge along the channel at a leading ridge edge at a leading slot boundary and resuming the ridge at a following ridge edge at a following slot boundary, said slot between ridge leading and following edges defining a slot width approximately equal to a wall stud cross-sectional width, the ridge continuing from a first slot to a successive slot wherein the beam flange and ridge projecting therefrom comprise a first side member depending from the beam flange, a first ridge member bending from the first side member at its distal end, a second ridge member bending from the first ridge member back toward the beam flange, a second side member bending from the second ridge member approximately parallel to the first ridge member and away from the web.

6. A support beam comprising a horizontal web, first and second opposing flanges depending vertically and approximately perpendicular from the web in parallel, spaced apart relation, the web and depending first and second opposing flanges forming a generally U-shaped channel having a channel width defined between the opposing flanges approximately equal to a building stud cross-sectional length and a channel depth defined by an extent of the opposing flanges from the web, a stud-receiving means for slidably securing said studs in the channel and including restraints against lateral movement of a stud in the channel with unrestricted and unlimited sliding movement of the stud in the channel perpendicular to the channel web wherein said stud receiving means further comprises at least one chute perpendicular to the channel web for receiving and guiding a stud in said channel, said chute comprising a first pair of guide members aligned in a plane perpendicular to the beam web and adapted to receive and engage a building stud along a same stud side to maintain the stud perpendicular to the web.

7. The support beam of claim 6 wherein said guides members comprise a first projection inward of the channel from a first position on a first beam flange and a second projection inward of the channel from said first beam flange projecting from a second position on said first beam flange spaced apart from the first position and aligned therewith in a plane perpendicular to the web.

8. The support beam of claim 7 wherein said first and second projections join at a position within the channel for mutual enhanced rigidity.

9. The support beam of claim 6 wherein said first pair of guide members comprises a first projection inward of the channel from a first position on a first beam flange, a second projection inward of the channel from said first beam flange projecting from a second position on the same first beam flange spaced apart from the first position and aligned therewith in a plane perpendicular to the web, and further comprising a second pair of guide members also aligned in a plane perpendicular to the beam web and adapted to receive a building stud along a same stud side to maintain the stud in a plane perpendicular to the web, said second pair of guide members comprising a third projection inward of the channel from a third position on a second beam flange, a fourth projection inward of the channel from said second beam flange projecting from a fourth position on the same second beam flange spaced apart from the third position and aligned therewith in a plane perpendicular to the web.

10. The support beam of claim 9 wherein the first and third projections are opposing in approximate horizontal alignment.

11. The support beam of claim 9 wherein the first and third projections and the second and fourth projections are opposing pairs, each pair in approximate horizontal alignment.

12. The support beam of claim 7 wherein respective distal ends of the first and second projections are connected inward of the channel by a third member.

13. The support beam of claim 6 wherein said guide members comprise a leading beam protrusion inward of the channel intermediate the beam flange, spaced apart from the flange distal end, having a leading protrusion edge at a leading chute boundary and a following beam protrusion having a following protrusion edge at a following chute boundary, said chute between protrusion leading edge and protrusion following edge defining a chute width approximately equal to a wall stud cross-sectional width.

14. The beam of claim 13 wherein the protrusion further comprises first and second portions projecting from a same beam flange and joining at a protrusion projection distance, said leading protrusion edge comprising a first portion leading edge and a second portion leading edge and said following protrusion edge similarly comprising a first portion following edge and a second portion following edge.

15. The beam of claim 14 wherein said leading protrusion edges of said protrusion first portion and protrusion second portion are aligned in a first plane approximately perpendicular to the web and to the at least one flange and said respective leading edges of said first portion and said second portion are aligned in a second plane parallel to the first plane and spaced apart therefrom a distance approximately equal to a cross-sectional width of a building stud forming a chute normal to the web bounded on first opposing sides by the vertically-aligned leading edges and following edges and by second opposing sides comprising said beam flanges for slidably supporting a building stud therein.

16. A support beam comprising a horizontal web, first and second opposing flanges depending vertically and approximately perpendicular from the web in parallel, spaced apart relation, the web and depending first and second opposing flanges forming a generally U-shaped channel having a channel width defined between the opposing flanges less than a building stud cross-sectional length and a channel depth defined by a flange extent of the opposing flanges from the web, a chute in the opposing flanges perpendicular to the web for receiving and supporting a building stud in the channel, the chute comprising opposing protrusions outward of the channel on each flange forming a plurality of guides into which a stud may fit and be held perpendicular to the web.

17. A support beam comprising a horizontal web, first and second opposing flanges depending vertically and approximately perpendicular from the web in parallel, in spaced apart relation, the web and depending first and second opposing flanges forming a generally U-shaped channel with first and second channel ends and having a channel width defined between the opposing flanges approximately equal to a building stud cross-sectional length and a channel depth defined by an extent of the opposing flanges from the web, a first side member depending from the beam flange, a first ridge member bending from the first side member at its distal end, a second ridge member bending from the first ridge member back toward the beam flange, a second side member bending from the second ridge member approximately parallel to the first ridge member and away from the web.

* * * * *